US012179079B1

(12) United States Patent
Cseplo et al.

(10) Patent No.: US 12,179,079 B1
(45) Date of Patent: Dec. 31, 2024

(54) TRAINING BASEBALL BAT

(71) Applicant: William P. Cseplo, Naples, FL (US)

(72) Inventors: William P. Cseplo, Naples, FL (US); Joel Armbruster, Galloway, OH (US)

(73) Assignee: William P. Cseplo, Naples, FL (US)

( * ) Notice: Subject to any disclaimer, the term of this patent is extended or adjusted under 35 U.S.C. 154(b) by 0 days.

(21) Appl. No.: 18/679,966

(22) Filed: May 31, 2024

Related U.S. Application Data

(60) Provisional application No. 63/505,623, filed on Jun. 1, 2023.

(51) Int. Cl.
*A63B 69/00* (2006.01)
*A63B 102/18* (2015.01)

(52) U.S. Cl.
CPC .. *A63B 69/0002* (2013.01); *A63B 2069/0008* (2013.01); *A63B 2102/18* (2015.10)

(58) Field of Classification Search
CPC ..... A63B 69/0002; A63B 2069/0008; A63B 2102/18
USPC ..... 473/422, 228, 437, 457, 519, 520, 473/564–568
See application file for complete search history.

(56) References Cited

U.S. PATENT DOCUMENTS 514,420 A * 2/1894 Jacobus
3,137,504 A * 6/1964 Zordan ..... A63B 59/50 446/421
4,898,386 A * 2/1990 Anderson ..... A63B 59/51 473/457
4,967,596 A 11/1990 Rilling et al.
5,277,421 A * 1/1994 Rewolinski ..... A63B 60/04 473/457
6,830,520 B1 12/2004 Bollar
7,147,580 B2 * 12/2006 Nutter ..... A63B 69/0002 473/457
8,888,614 B2 11/2014 Nutter
9,144,726 B2 9/2015 Whitney et al.
9,486,685 B2 * 11/2016 Rambo ..... A63B 71/0619
9,579,557 B1 * 2/2017 Molinelli ..... G09B 19/0038
11,241,607 B2 2/2022 Kim
(Continued)

FOREIGN PATENT DOCUMENTS

JP 2867010 B2 3/1999
KR 20-0438370 Y1 2/2008
KR 10-1321665 B1 10/2013

*Primary Examiner* — Nini F Legesse
(74) *Attorney, Agent, or Firm* — Porter Wright Morris & Arthur LLP

(57) ABSTRACT

A training baseball bat comprises (a) a bat with a cylindrical axial cavity; (b) a sealing cap arranged in and sealing the cavity at one end; and (c) a training apparatus positioned in the cavity and comprising a magnet fixed at one end of the cavity; a stopper fixed within the cavity adjacent to the sealing cap; and a cylinder slidably positioned in the cavity which, when released from the magnet, can travel the length of the cavity and contact the stopper to exert an auditory signal. The training baseball bat also includes at least two reinforcing pins arranged perpendicular to the cavity and perpendicular to and spaced from one another along the length of the cavity between the sealing cap and the stopper, each pin extending through the cavity and across a substantial portion of the diameter of the head.

17 Claims, 1 Drawing Sheet

(56) References Cited

U.S. PATENT DOCUMENTS

| | | | | |
|---|---|---|---|---|
| 2009/0011871 | A1 | 1/2009 | Kelly | |
| 2014/0121042 | A1 * | 5/2014 | Nutter | A63B 69/00 473/457 |

* cited by examiner

TRAINING BASEBALL BAT

FIELD OF THE INVENTION

The present invention relates to a training baseball bat for improving batting swing performance and accuracy for a user.

BACKGROUND OF THE INVENTION

Sports players of all kinds, whether youth, adult, recreational or professional, undertake much time and effort to improve their skills for the sport(s) they play and enjoy. Most sports or other activities require fundamental skills that serve as building blocks for learning and improving abilities within those sports or activities.

With baseball and softball, one of those fundamental skills includes learning how to properly swing a baseball bat to make contact with the desired target, such as a baseball or a softball. A common training tool for users to learn how to properly swing a baseball bat includes the use of a batting tee, often used for youth in leagues such as "tee ball." A batting tee allows a user to place a baseball stationary on top of the tee at the proper hitting height so the user can learn to swing a bat properly to hit the stationary baseball object, before progressing to a moving baseball target, such as when a ball is thrown by a pitcher.

Additional training devices have been developed to improve a user's batting swing such as portable training stations, harnesses, swing trainers, hitting sticks, and ball weights. These devices use various strategies for improving a user's swing to accurately and forcefully hit a baseball or softball at the right force, angle, and time to hit a ball further, faster, and more accurately. While many of these training devices can aid users in improving their skill, most known training devices do not resemble or consist of an actual regulation shape and size baseball bat, complimentary to a bat that will be used outside of training practices.

In view of the above, there is a continuous need to develop new and improved baseball and softball (collectively, baseball) training devices.

Accordingly, an improved baseball training apparatus is desirable.

SUMMARY OF THE INVENTION

It is therefore an object of the invention to provide a training baseball bat. While "baseball bat" is used throughout this disclosure, the term encompasses "softball bat" as well. One of ordinary skill in the art will appreciate that there are differences in length, width, weight and handles between "regulation" baseball bats and softball bats, but the novel features of the inventive training bat may be incorporated in both baseball bats and softball bats.

In one embodiment, the inventive training baseball bat comprises (a) a baseball bat comprising a head portion and a handle portion, wherein a cylindrical axial cavity extends from an end of the head portion which is distal to the handle towards the handle portion along a length of the head portion; (b) a sealing cap arranged in and sealing the cavity at the end of the head portion which is distal to the handle portion; (c) a training apparatus positioned in the cavity, and (d) at least two reinforcing pins. The training apparatus comprises a magnet fixed at an end of the cavity opposite the sealing cap; a stopper fixed within the cavity adjacent to and spaced from the sealing cap; and a ferromagnetic cylinder positioned in the cavity between the stopper and the magnet and slideable therebetween. The magnet is of a strength to magnetically hold the cylinder thereto until the bat is swung at a sufficient speed and proper arc to release the cylinder from the magnet, and, when released from the magnet, the cylinder is sufficiently slideable in the cavity to travel the length of the cavity and contact the stopper to exert an auditory signal. The at least two reinforcing pins are arranged perpendicular to the cavity and perpendicular to and spaced from one another along the length of the cavity between the sealing cap and the stopper, each pin extending through the cavity and across a substantial portion of the diameter of the head.

The training baseball bat allows a user to receive an auditory signal when the bat is swung at a sufficient speed and proper arc for hitting a baseball or softball. Additionally, the training baseball bat is durable and allows repeated use to provide continued training. These and additional objects and advantages of the training baseball bat of the invention will be more fully apparent in view of the following detailed description.

BRIEF DESCRIPTION OF THE DRAWINGS

The drawings are illustrative of certain embodiments of the invention and are exemplary in nature and are not intended to limit the invention defined by the claims, wherein:

DETAILED DESCRIPTION

Specific embodiments of the invention are described herein. The invention can, however, be embodied in different forms and should not be construed as limited to the embodiments set forth herein. Rather, these embodiments are provided to illustrate more specific features of certain embodiments of the invention to those skilled in the art.

The terminology as set forth herein is for description of the embodiments only and should not be construed as limiting the disclosure as a whole. All references to singular characteristics or limitations of the present disclosure shall include the corresponding plural characteristic or limitation, and vice versa, unless otherwise specified or clearly implied to the contrary by the context in which the reference is made. Unless otherwise specified, "a," "an," "the," and "at least one" are used interchangeably. Furthermore, as used in the description and the appended claims, the singular forms "a," "an," and "the" are inclusive of their plural forms, unless the context clearly indicates otherwise.

To the extent that the term "includes" or "including" is used in the description or the claims, it is intended to be inclusive of additional elements or steps, in a manner similar to the term "comprising" as that term is interpreted when employed as a transitional word in a claim. Furthermore, to the extent that the term "or" is employed (e.g., A or B), it is intended to mean "A or B or both." When the "only A or B but not both" is intended, then the term "only A or B but not both" is employed. Thus, use of the term "or" herein is the inclusive, and not the exclusive use. When the term "and" as well as "or" are used together, as in "A and/or B" this indicates A or B as well as A and B.

All ranges and parameters, including but not limited to percentages, parts, and ratios disclosed herein are understood to encompass any and all sub-ranges subsumed therein, and every number between the endpoints. For example, a stated range of "1 to 10" should be considered to include any and all sub-ranges beginning with a minimum value of 1 or more and ending with a maximum value of 10 or less (e.g., 1 to 6.1, or 2.3 to 9.4), and to each integer (1, 2, 3, 4, 5, 6, 7, 8, 9, and 10) contained within the range.

Figure 1:
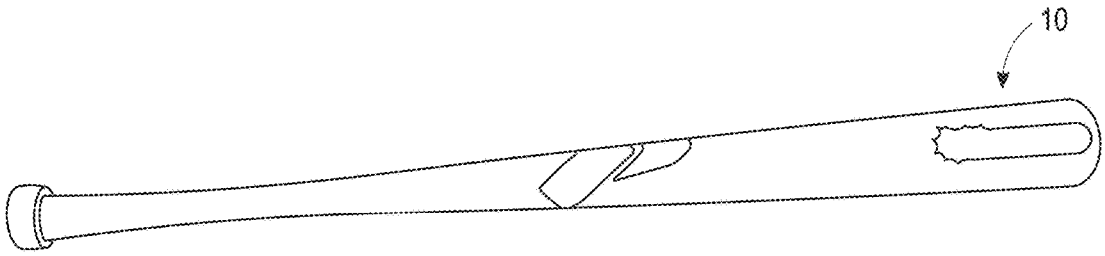
FIG. 1 illustrates a front view of a training baseball bat according to one embodiment of the invention.
Figure 2:
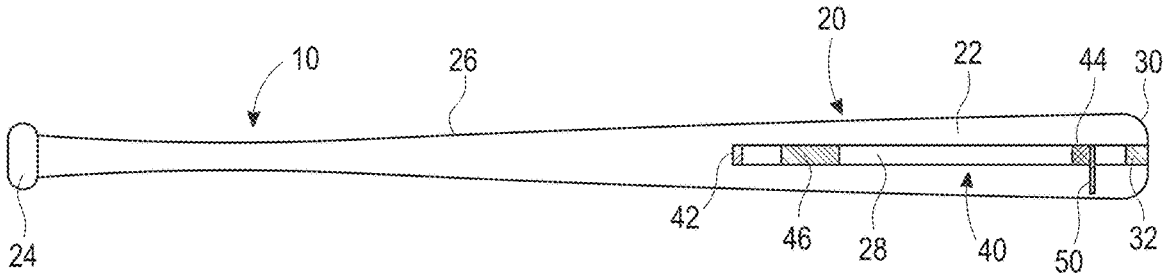
FIG. 2 illustrates a schematic internal view of the training baseball bat according to an embodiment of the invention.
Figure 3:
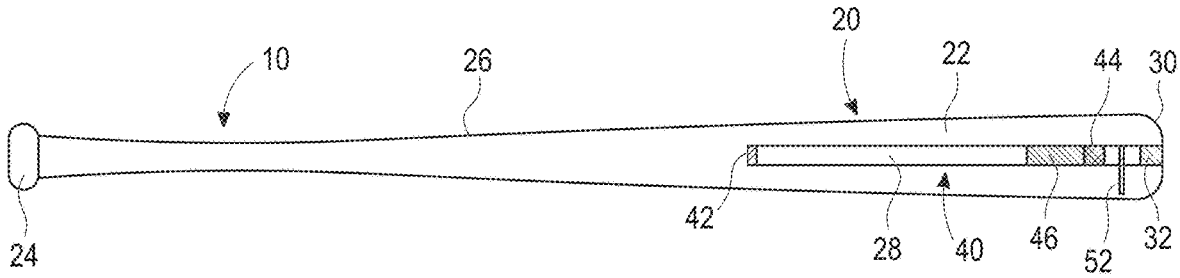
FIG. 3 illustrates another schematic internal view of the training baseball bat according to the embodiment of the invention shown in FIG. 2, wherein the training baseball bat has been rotated 90°.

As indicated above, the present invention is directed to a training baseball bat comprising (a) a baseball bat; (b) a sealing cap; (c) a training apparatus; and (d) reinforcing pins. The baseball bat advantageously has the configuration and outer dimensions of a standard or regulation baseball bat as shown in FIGS. 1-3. With reference to FIGS. 1-3, the training baseball bat 10 comprises the baseball bat 20 including a head portion 22 and a handle portion 24. The external view of the head portion 22 may advantageously resemble a head portion of any standard or regulation baseball bat known in the art. Thus, the head portion 22 may be primarily cylindrical in shape and may be various lengths and widths to accompany varying sized baseball bats depending on age, height and preferences of the user, as well as to vary as necessary to serve for hitting baseballs, softballs, whiffle balls, tennis balls, or the like.

In a specific embodiment of the invention, the training baseball bat is designed to be used with tennis balls or whiffle balls for proper alignment training. Such alignment training can train a user a proper hitting technique with the training baseball bat and whiffle balls and/or tennis balls in order to prepare the user for using an actual regulation baseball bat for hitting baseballs or softballs.

As shown in FIGS. 2 and 3, the handle portion 24 meets with the head portion 22 of the baseball bat seamless at or about a midline 26 of the bat. The external view of the handle portion 24 may resemble a handle portion of any standard or regulation baseball bat known in the art. That is, the handle portion 24 may be substantially cylindrical in shape, with a diameter smaller than a diameter of the head portion, such as shown in the figures. The handle portion 24 may or may not include a cap end in varying shapes or sizes at an end of the baseball bat.

According to embodiments of the invention, the baseball bat may be made of wood, metal, for example, aluminum, or a composite material, for example, carbon fiber, fiberglass, and resin, or other suitable materials known in the art.

The baseball bat 20 is provided with a cylindrical axial cavity 28 which extends from an end 30 of the head portion which is distal to the handle portion towards the handle portion along a length of the head portion. The length of the cavity 28 may vary, for example, depending on the size of the baseball bat, and optionally, the skill level of the intended user. In a specific embodiment, the length of the cavity is from about one quarter to about one half of the length of the baseball bat. In a more specific embodiment, the length of the cavity is about one third of the length of the baseball bat. The diameter of the cavity may also vary, for example, depending on the size of the baseball bat, and optionally, the skill level of the intended user. In a specific embodiment, the diameter of the cavity is about ½ inch.

A sealing cap 32 is arranged in and seals the cavity 28 at the end 30 of the head portion of the baseball bat which is distal to the handle portion. The sealing cap prevents debris from entering the cavity. The sealing cap may be held in place at the end of the cavity by friction, an adhesive, or other means. In a specific embodiment, the sealing cap includes a metal crimp arranged at the end of the cavity.

The training apparatus, shown generally at 40 in FIGS. 2 and 3, is positioned in the cavity 28. The training apparatus 40 is preferably entirely integral to the interior of the baseball bat and is operable to train a user to execute a proper swing of the bat to hit an ideal target, including, but not limited to, a baseball or a softball. The training apparatus comprises a magnet 42 fixed at an end of the cavity opposite the sealing cap 32, and a stopper 44 fixed within the cavity adjacent to and spaced from the sealing cap 32. The position of the stopper 44 in the cavity should allow sufficient space for the reinforcing pins, discussed below, to be positioned between the stopper 44 and the sealing cap 32. In a specific embodiment, the stopper is fixed at a positon of from about 1 to 2 inches from the end 30 of the head portion which is distal to the handle portion. Both the magnet and the stopper are stationary within the cavity and preferably have a diameter that is the same or substantially similar to the diameter of the cavity to facilitate their retention in their respective positions. The magnet and stopper may be held in place by friction, an adhesive, or other means. The magnet may be of any material and strength that allows retention and release of the cylinder as discussed below. The stopper may be made of a variety of materials, densities and lengths depending on the size of the bat, with the ability, in cooperation with the cylinder as discussed below, to omit an auditory signal upon execution of a proper swing of the training baseball bat. In a specific embodiment, the stopper is formed of metal.

The training apparatus further comprises a ferromagnetic cylinder 46 positioned in the cavity between the magnet 42 and the stopper 44 and slideable therebetween. The cylinder 46 is magnetically held by the magnet 42 prior to a swing of the baseball bat. The magnet 42 is of a strength to magnetically hold the cylinder 46 thereto until the bat is swung at a sufficient speed and proper arc for hitting a baseball or softball, at which point, the force of the proper swing releases the cylinder from the magnet. The cylinder 46 suitably has a diameter that is slightly smaller than the diameter of the cavity. Therefore, when released from the magnet, the cylinder 46 is sufficiently slidable in the cavity to travel the length of the cavity and contact the stopper 44 with sufficient force to exert an auditory signal. The cylinder may be made of any of a variety of ferromagnetic materials. In a specific embodiment, the cylinder if formed of steel or iron. The length of the cylinder may vary, for example, depending on the size of the bat, skill level of an intended user, and/or the desired positioning that contributes to the force which accompanies the execution of a proper swing of the baseball bat. In a specific embodiment, the cylinder has a length of about 1 to 3 inches, or, more specifically, from about 1 to 2 inches, or, yet more specifically, about 1.5 inches.

The auditory signal which is results from a proper swing of the baseball bat will vary in intensity and duration depending on the size of the cylinder and the material of the stopper as well as the velocity at which the cylinder contacts the stopper to exert the auditory signal. Movement of the baseball bat at the proper speed and arc will cause the cylinder to slide freely within the cavity, i.e., when an adequate amount of speed and positioning is exerted on the bat when it is properly swung by a user. However, the cylinder will only release from the magnet and reach the stopper if and when the user executes a proper swing. If the user therefore hears the auditory signal upon swinging the bat, the auditory signal relays a decisive indication to the user that a proper swing with the proper amount of speed and positioning has been executed as if the user were swinging a regulation baseball bat at an intended baseball (or similar) target.

The collective positioning of the stopper and the cylinder, and the cooperation of the magnet, cylinder and stopper of the training apparatus within the baseball bat produce the auditory signal only when a user swings the baseball bat in a proper swing. The baseball bat will indicate to the user if an ideal swing is achieved if the auditory signal occurs, representing when the bat would ideally contact an actual ball or target. In essence, the auditory signal is meant to simulate a "crack" noise that is typically heard when a baseball bat successfully hits a baseball. The auditory signal will help a user understand the mechanics and other technical aspects of eliciting a proper swing to hit a target, such as a baseball.

The training baseball bat further includes at least two reinforcing pins to provide durability to the training baseball bat, allowing continued use to improve a user's swing. As shown in FIGS. 2 and 3, the reinforcing pins 50 and 52 are spaced from one another along the length of the cavity between the sealing cap and the stopper. The reinforcing pin 50 is located adjacent the stopper 44, and can assist in maintaining the stopper in place in the cavity. The reinforcing pin 52 is located about ½ to 1 inch from the first reinforcing pin 50 in the direction of the sealing cap. The reinforcing pins are positioned perpendicular to the cavity in order to reinforce the structural integrity of the end region of the baseball bat head portion. Further, each pin extends through the cavity and across a substantial portion of the diameter of the head portion to provide additional structural integrity to the training baseball bat. As is evident from a comparison of FIGS. 2 and 3, the reinforcing pins are positioned perpendicular to one another, albeit in parallel planes. Additional reinforcing pins may be included, if desired, arranged spaced from reinforcing pins 50 and 52, and/or at an angle with one or both of reinforcing pins 50 and 52. In a specific embodiment, any additional reinforcing pins also extend through the cavity and across a substantial portion of the diameter of the head portion to provide additional structural integrity to the training baseball bat.

In one embodiment, the training apparatus is completely integrated into the bat as a permanent feature. In a specific embodiment, the cavity is drilled into the head portion of the baseball bat. In another embodiment, the head portion may include an added internal structure which provides the cavity for receiving the training apparatus. In another embodiment, the bat may comprise a first half and a second half, wherein the halves are joined along a longitudinal midline of the bat.

The specific embodiments and examples described herein are exemplary only and are not limiting to the invention defined in the claims. Additionally, while the present invention has been illustrated by the description of embodiments thereof, and while the embodiments have been described in considerable detail, such descriptions are not intended to restrict or in any way limit the scope of the appended claims to such detail. Additional advantages and modifications will readily appear to those skilled in the art. Therefore, the invention, in its broader aspects, is not limited to the specific details, the representative compositions and processes, or illustrative examples shown and described. Accordingly, departures may be made from such details without departing from the spirit or scope of the general inventive concept.

What is claimed is:

1. A training baseball bat, comprising:

(a) a baseball bat comprising a head portion and a handle portion, wherein a cylindrical axial cavity extends from an end of the head portion which is distal to the handle portion towards the handle portion along a length of the head portion;

(b) a sealing cap arranged in and sealing the cavity at the end of the head portion which is distal to the handle portion;

(c) a training apparatus positioned in the cavity, the training apparatus comprising:

a magnet fixed at an end of the cavity opposite the sealing cap;

a stopper fixed within the cavity adjacent to and spaced from the sealing cap; and a ferromagnetic cylinder positioned in the cavity between the stopper and the magnet and slideable therebetween, wherein the magnet is of a strength to magnetically hold the cylinder thereto until the bat is swung at a sufficient speed and proper arc to release the cylinder from the magnet, and wherein, when released from the magnet, the cylinder is sufficiently slideable in the cavity to travel the length of the cavity and contact the stopper to exert an auditory signal; and (d) at least two reinforcing pins arranged perpendicular to the cavity and perpendicular to and spaced from one another along the length of the cavity between the sealing cap and the stopper, each pin extending through the cavity and across a substantial portion of the diameter of the head portion.

2. The training baseball bat of claim 1, wherein the cylindrical axial cavity extends along about one third of the length of the baseball bat.

3. The training baseball bat of claim 1, wherein the cylindrical axial cavity has a diameter of ½ inch.

4. The training baseball bat of claim 1, wherein the stopper is fixed at a position of from about 1 to 2 inches from the end of the head portion which is distal to the handle portion.

5. The training baseball bat of claim 1, wherein the cylinder is formed of iron or steel.

6. The training baseball bat of claim 1, wherein the cylinder has a length of about 1 to 3 inches.

7. The training baseball bat of claim 1, wherein the stopper is formed of metal.

8. The training baseball bat of claim 7, wherein the reinforcing pins are formed of metal.

9. The training baseball bat of claim 1, wherein the reinforcing pins are formed of metal.

10. The training baseball bat of claim 9, wherein the reinforcing pins are formed of steel.

11. The training baseball bat of claim 1, wherein the baseball bat is formed of wood.

12. The training baseball bat of claim 1, wherein the baseball bat is formed of metal.

13. The training baseball bat of claim 1, wherein one of the reinforcing pins is located adjacent the stopper.

14. The training baseball bat of claim 13, wherein another of the reinforcing pins is located about ½ inch away from the one reinforcing pin.

15. A training baseball bat, comprising:

(a) a wooden baseball bat comprising a head portion and a handle portion, wherein a cylindrical axial cavity extends from an end of the head portion which is distal to the handle portion towards the handle portion along a length of the head portion;

(b) a sealing cap arranged in and sealing the cavity at the end of the head portion which is distal to the handle portion;

(c) a training apparatus positioned in the cavity, the training apparatus comprising:

a magnet fixed at an end of the cavity opposite the sealing cap;

a metal stopper fixed within the cavity adjacent to and spaced from the sealing cap; and a ferromagnetic cylinder positioned in the cavity between the stopper and the rod and slideable therebetween, wherein the magnet is of a strength to magnetically hold the cylinder thereto until the bat is swung at a sufficient speed and proper arc to release the cylinder from the magnet, and wherein, when released from the magnet, the cylinder is sufficiently slideable in the cavity to travel the length of the cavity and contact the stopper to exert an auditory signal; and (d) at least two metal reinforcing pins arranged perpendicular to the cavity and perpendicular to and spaced from one another along the length of the cavity between the sealing cap and the stopper, each pin extending through the cavity and across a substantial portion of the diameter of the head portion.

16. The training baseball bat of claim 15, wherein the cylindrical axial cavity has a diameter of about ½ inch.

17. The training baseball bat of claim 15, wherein the length of the cavity is from about one quarter to about one half of the length of the baseball bat.

* * * * *